US005345297A

United States Patent [19]

Katakabe et al.

[11] Patent Number: 5,345,297

[45] Date of Patent: Sep. 6, 1994

[54] DEVELOPING APPARATUS

[75] Inventors: Noboru Katakabe, Uji; Masanori Yoshikawa, Neyagawa, both of Japan

[73] Assignee: Matsushita Electric Industrial Co., Ltd., Osaka, Japan

[21] Appl. No.: 28,541

[22] Filed: Mar. 8, 1993

[30] Foreign Application Priority Data

Mar. 9, 1992 [JP] Japan ..... 4-050278

[51] Int. Cl.[5] ..... G03G 15/08

[52] U.S. Cl. ..... 355/260; 222/DIG. 1; 355/245

[58] Field of Search ..... 355/260, 245, 206, 207, 355/208, 246, 203, 204, 209; 222/DIG. 1; 118/688, 689, 691, 653, 656

[56] References Cited

U.S. PATENT DOCUMENTS 4,060,105 11/1977 Feldeisen et al. .
4,304,273 12/1981 Caudill et al. ..... 141/268
4,615,364 10/1986 Kawata ..... 222/DIG. 1 X
4,834,246 5/1989 Inoue et al. ..... 206/631
4,937,628 6/1990 Cipolla et al. ..... 355/260
5,089,854 2/1992 Kaieda et al. ..... 355/260
5,111,976 5/1992 Ban ..... 222/485
5,150,162 9/1992 Saito ..... 355/260
5,235,389 8/1993 Kikuchi et al. ..... 355/260

*Primary Examiner*—A. T. Grimley
*Assistant Examiner*—T. A. Dang
*Attorney, Agent, or Firm*—Wenderoth, Lind & Ponack

[57] ABSTRACT

A developing apparatus is arranged so that a toner container having an opening portion which can be opened or closed is engaged with a toner replenishing opening of a toner hopper so as to open the opening portion of the toner container. A rotary shaft extends through the toner container, has a toner stirring member mounted thereto, and is coupled with a driving shaft of an agitator. When rotated by the driving shaft of the agitator, the rotary shaft causes the toner in the toner container to drop into the toner hopper due to rotation of the stirring member within the toner container, which rotates simultaneously with the agitator in the hopper.

10 Claims, 9 Drawing Sheets

DEVELOPING APPARATUS

BACKGROUND OF THE INVENTION

The present invention generally relates to electrophotography, and more particularly, to a developing apparatus employing a toner container used in feeding toner to an electrophotographic system.

In electrophotographic output arrangements in copying apparatuses, laser printers or the like, there have conventionally been proposed several toner replenishing methods for actual applications.

Referring to FIGS. 10 and 11, one example of such known toner containers and developing apparatuses will be described hereinbelow.

In FIG. 10, a toner container main body 101 of a generally rectangular cubic box-like configuration open at an upper portion and containing toner 103 accommodated therein is sealed at its open portion by sealing material 102 for tightly enclosing the toner therein. Meanwhile in FIG. 11 a developing apparatus main body 111 schematically shown has an opening at its upper portion of replenishing toner in a toner hopper 112.

In the above arrangement, when all of the toner in the developing apparatus 111 has been consumed, the toner container 101 is first detached from the developing apparatus main body 111, and a fresh toner container 101 is mounted on the developing apparatus main body 111 with the sealing material 102 attached. The sealing material 102 is then pulled off in a direction indicated by an arrow to open the opening portion of the toner container 101, whereby toner is replenished in the toner hopper 112.

In the known construction as described above, however, there are problems, in that, since the toner adhering to the inner wall of the container tends to fall during detachment of the toner container 101 after use, or toner stuck to the sealing material 102 falls or scatters when the sealing material 102 is pulled off, the apparatus main body 111, hands and clothes of workers, etc. are undesirably soiled.

SUMMARY OF THE INVENTION

Accordingly, an essential object of the present invention is to provide a developing apparatus employing a toner container, in which sealing or opening of the toner container, and also toner replenishment can be readily effected positively without scattering of toner, i.e. without soiling the apparatus main body, hands or clothes of workers, etc. during replenishment of toner.

Another object of the present invention is to provide a toner container and a developing apparatus of the above described type in which feeding of toner for replenishment of a toner hopper can be positively effected without stopping even when the toner container is compact in size and has a small toner discharge port.

A further object of the present invention is to provide a developing apparatus of the above described type for which toner is not spilled even when a worker operates it incorrectly.

In accomplishing these and other objects, according to one aspect of the present invention, the toner container is provided with an open/close means for selectively opening or closing an opening portion of a toner discharge port of the container main body, and a stirring means having a rotary shaft extending through the toner container for stirring the toner contained within the toner container from outside thereof.

In another aspect of the present invention, the toner container is arranged, by the engagement thereof with a toner replenishing port of a developing apparatus, to be changed over between one state in which the toner container is detachable and the discharge port is closed, and another state in which the toner container is undetachable and the discharge port is open.

In still another aspect of the present invention, the developing apparatus is provided with a toner replenishing port which is fitted with the toner container while the toner discharge port of the toner container is directed downwards, and a vertically directed driving shaft to be connected with the rotary shaft of the toner container.

In a further aspect of the present invention, the developing apparatus is provided with a developing roller supported in a horizontal direction, and a toner transport means disposed in parallel with the developing roller, in such a manner that the toner is transported when the driving shaft is rotated.

With the above arrangement according to the present invention, the toner can be efficiently discharged from the toner container even through a small opening portion, which may otherwise obstruct replenishment of toner by gravity due to aggregation thereof, through agitation of the toner in the toner container by rotating the stirring means from outside. Simultaneously, the inconveniences in the conventional arrangements such as scattering of toner during removal of the seal for the toner container or spilling of toner from the toner container after replenishment, etc. can be advantageously eliminated.

Moreover, by the above construction, discharge of toner from the toner container may be automatically effected so as to simplify the toner replenishing process.

Furthermore, in the above arrangement, the open/close function of the opening portion and the prevention of detachment of the toner container are associated with each other so that the toner container can not be detached while the opening portion is kept open, and therefore, scattering of toner by mistake on the part of a worker can be advantageously prevented.

Additionally, by the above arrangement, since it becomes possible to supply toner to the developing roller via the toner transport means simultaneously with the toner replenishing function, the initializing operation of the developing apparatus after replenishment of the toner can be dispensed with or reduced.

BRIEF DESCRIPTION OF THE DRAWINGS

These and other objects and features of the present invention will become apparent from the following description taken in conjunction with the preferred embodiment thereof with reference to the accompanying drawings in which.

DETAILED DESCRIPTION OF THE INVENTION

Figure 1A:
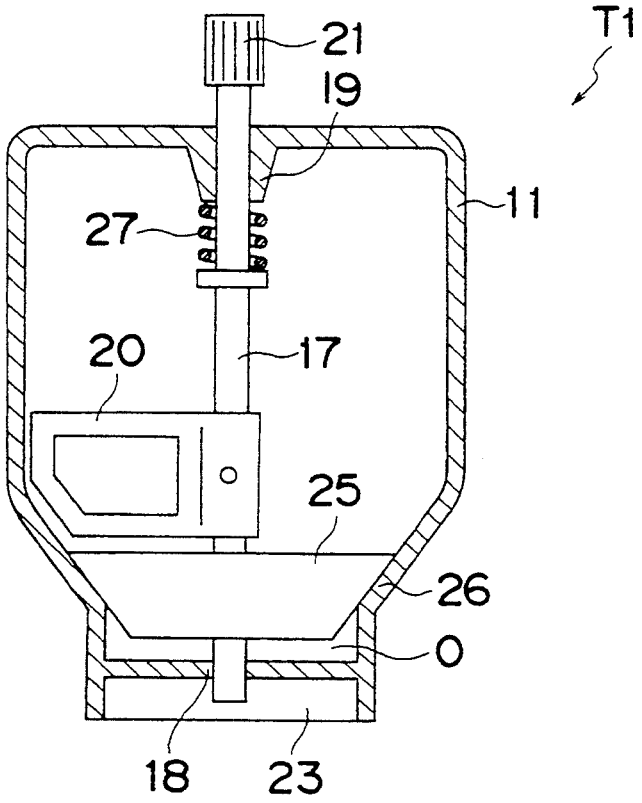
FIG. 1(A) is a side sectional view of a toner container according to a first embodiment of the present invention.

Before the description of the present invention proceeds, it is to be noted that like parts are designated by like reference numerals throughout the accompanying drawings.

Figure 1B:
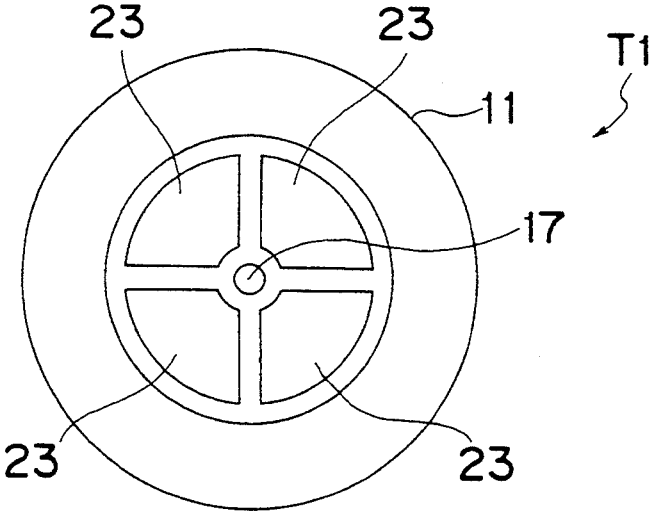
FIG. 1(B) is a bottom plan view of the toner container of FIG. 1 (A)

Referring now to the drawings, there is shown in FIGS. 1(A) and 1(B), a toner container T1 according to a first embodiment of the present invention, which generally includes a container main body 11, a rotary shaft 17 extending through the container main body 11 and rotatably supported by bearing portions 18 and 19 formed in the container main body 11, a stirring vane 20 fixed to the rotary shaft 17, a knob 21 formed at one end of the rotary shaft 17 projecting from an upper wall of the container main body 11 for rotating the shaft 17, and a toner valve 25 fixed to a lower portion of the rotary shaft 17. The toner valve 25 is held in pressure contact with a seat 26 for a toner discharge port 0 by a compression spring 27 provided at an upper portion of the rotary shaft 17 so as to normally urge the shaft downwardly. The discharge port 0 has an opening portion 23 formed by a plurality of openings (four openings as shown in FIG. 1(B)).

In the above arrangement for replenishing toner into a toner hopper of a separate developing apparatus (not shown here), the opening portion 23 of the container main body 11 is directed downward. In this case, since the toner valve 25 is held in contact with the seat 26 by the compression spring 27, the toner accommodated within the toner container is not discharged outside. Then, upon raising the knob 21 upwardly in FIG. 1(A), the toner valve 25 is spaced from the seat 26, and the toner falls through a gap therebetween. Furthermore, upon rotation or pivotal movement of the knob 21, the stirring blade 20 fixed to the rotary shaft 17 is rotated or pivoted, and the toner within the container main body 11 is agitated for higher fluidity so as to be readily discharged. Additionally, since the inner wall of the container main body 11 is so formed as to guide the toner towards the opening portion 23 of the discharge port 0 as shown in FIG. 1(A), the toner remaining within the container main body 11 during toner replenishment is advantageously reduced. Thus, after discharge of the toner within the container main body 11, and upon completion of toner replenishment, when the knob 21 is released, the toner valve 25 is brought into pressure contact with the seat 26 to again close the opening portion 23. Thus, the replenishing work may be completed without spilling toner remaining inside the container main body 11.

As described above, according to the above embodiment of the present invention, by providing the valve 25 for opening or closing the toner discharge port, and the stirring blade 20 which can be rotated from outside the toner container, scattering of toner before and after toner replenishment can be prevented, while the toner may be efficiently discharged without waste from the small opening portion. Therefore, a toner container which prevents soiling of hands or clothes during use can be realized.

It should be noted here that the arrangement according to the present invention is not limited to that as described above in the first embodiment, but may be varied in various ways within the scope. For example, the operation of the toner valve 25 described as manually effected may be modified to be carried out by other methods, e.g. in such a manner that, by providing a projection to push up the end portion of the rotary shaft 17 at the toner replenishing portion of the developing apparatus, the toner valve 25 is opened upon setting the container main body 11 thereon. Meanwhile, although the toner valve 25 is provided as an open/close means of the opening portion 23, this valve 25 may be adapted to also serve as a stirring means by providing a member for stirring toner as part of the valve. Furthermore, in the above embodiment, the open/close means of the opening portion 23 is set to be the toner valve 25, but the means is not limited to such toner valve 25 alone so far as it can selectively open or close the opening portion 23.

Figure 2A:
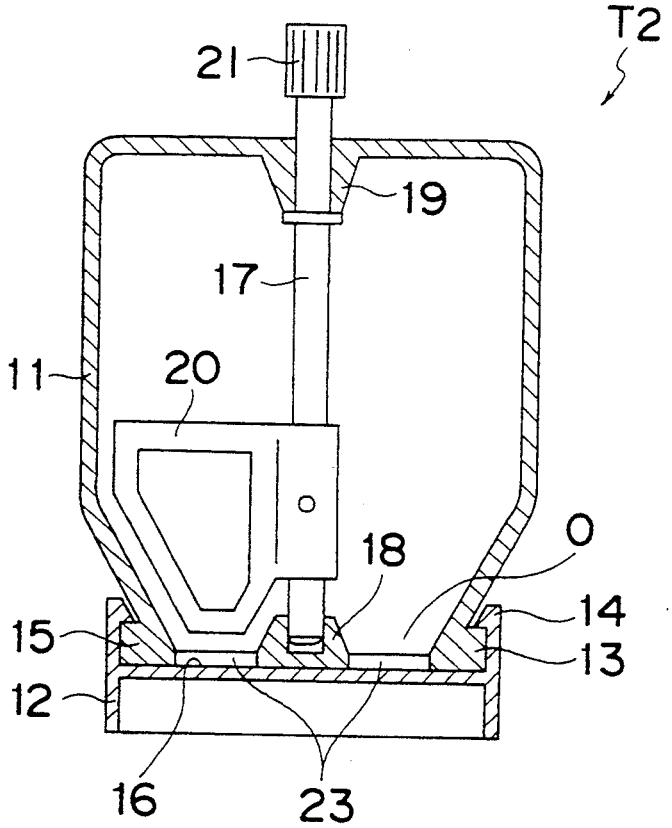
FIG. 2(A) is a side sectional view of a toner container according to a second embodiment of the present invention.
Figure 2B:
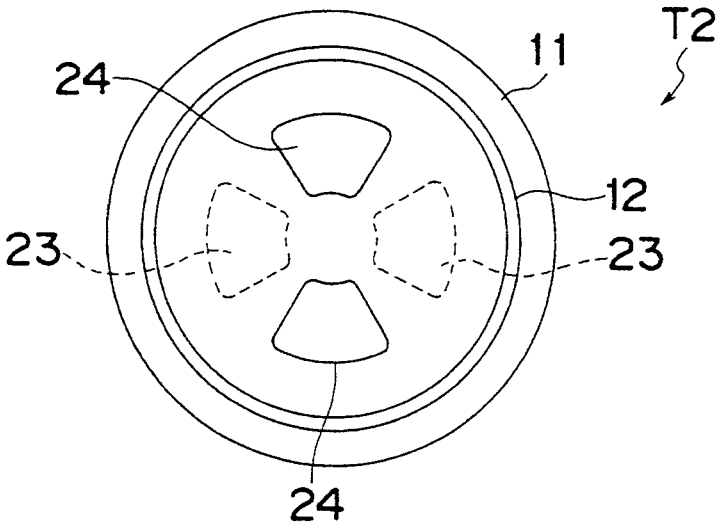
FIG. 2(B) is a bottom plan view of the toner container of FIG. 2(A)

FIGS. 2(A) and 2(B) show a toner container T2 according to a second embodiment of the present invention. The main differences between the second embodiment and the first embodiment are that the toner valve 25 together with the coil spring 27 in the first embodiment have been replaced by a cap member 12 whose claw 14 is engaged with a flange portion 13 of the container main body, and a lower peripheral face 15 of the container main body 11 is pressed against a sliding face 16 of the cap member 12 for sliding movement therebetween, and an opening portion 24 formed of a plurality of openings is provided in the cap member 12 in a position corresponding to the opening portion 23 provided in the face 15 of the container main body 11.

With the above arrangement, when the toner is to be supplied to a toner hopper of a separate developing apparatus (not shown here), the opening portion 23 of the container main body 11 is directed downward as shown in FIG. 2(A) towards a replenishing port of the toner hopper. At this time, since the openings of the opening portion 23 of the container main body 11 are deviated in position from the openings of the opening portion 24 of the cap member 12 (referred to as a closed state hereinafter), the toner in the toner container 11 does not come out. Subsequently, upon rotation of the cap member 12 to register the opening portion 23 with the opening portion 24 (referred to as an open state hereinafter), the toner accommodated within the container main body 11 passes through the opening portions 23 and 24 so as to fall by gravity. Furthermore, upon rotation or pivotal movement of the knob 21 by hand, the stirring blade 20 fixed to the rotary shaft 17 is rotated or pivoted, and the toner within the container main body 11 is agitated for higher fluidity so as to be readily discharged through the opening portions 23 and 24. Additionally, since the inner wall and the bearing portion 18 of the container main body 11 are so formed as to guide the toner towards the opening portion 23 of the discharge port 0 as shown in FIG. 2(A), the toner remaining within the container main body 11 during toner replenishment is advantageously reduced.

After discharge of the toner from the container main body 11, and upon completion of the toner replenishment, when the cap member 12 is again rotated to establish the closed state by deviating positions of the opening portions 23 and 24 and the container main body 11 is detached from the toner hopper, the replenishing work may be completed without spilling of toner remaining inside the toner container. During the above process, since the container main body 11 and the cap member 12 are closely connected, with the face 15 of the container main body 11 and the sliding face 16 of the cap member 12 being held in contact under pressure through engagement of the flange portion 13 of the container main body 11 with the claw portion of the cap member 12, there is no possibility that the toner will leak through such sliding portion.

As described above, according to the second embodiment of the present invention, by providing the cap member 12 capable of selectively opening or closing the toner discharge port 0 through sliding movement, and the stirring vane 20 which can be rotated or pivoted from outside the toner container, the toner discharge port 0 may be positively opened or closed through a simple operation such that scattering of toner before and after the toner replenishment can be prevented, and the toner may be efficiently discharged without waste from the small opening portion. Accordingly, the toner container which prevents soiling of hands or clothes during replenishment can be advantageously realized.

It should be noted here that in the above second embodiment, it is preferable that the opening portion 24 of the cap member 12 is set to be larger than the opening portion 23 of the toner container 11 so as to reduce the amount of toner adhering to the peripheral portion of the opening portion 24 during toner replenishment, whereby the possibility of soiling by toner can be further decreased.

The stirring vane 20 should preferably have a shape which will prevent aggregation of toner within the container main body 11, and should be of a configuration capable of agitating toner at least in the neighborhood of the opening portion 23.

Furthermore, it is preferable that the container main body 11 should be made of a transparent or semi-transparent material at least a part thereof so as to make it possible to view the remaining amount of toner from outside.

Since the remaining construction and function of the toner container T2 of the second embodiment are generally similar to those of the toner container T1 of FIGS. 1(A) and 1(B), the detailed description thereof is abbreviated here for brevity of explanation, with like parts being designated by like reference numerals.

Figure 3:
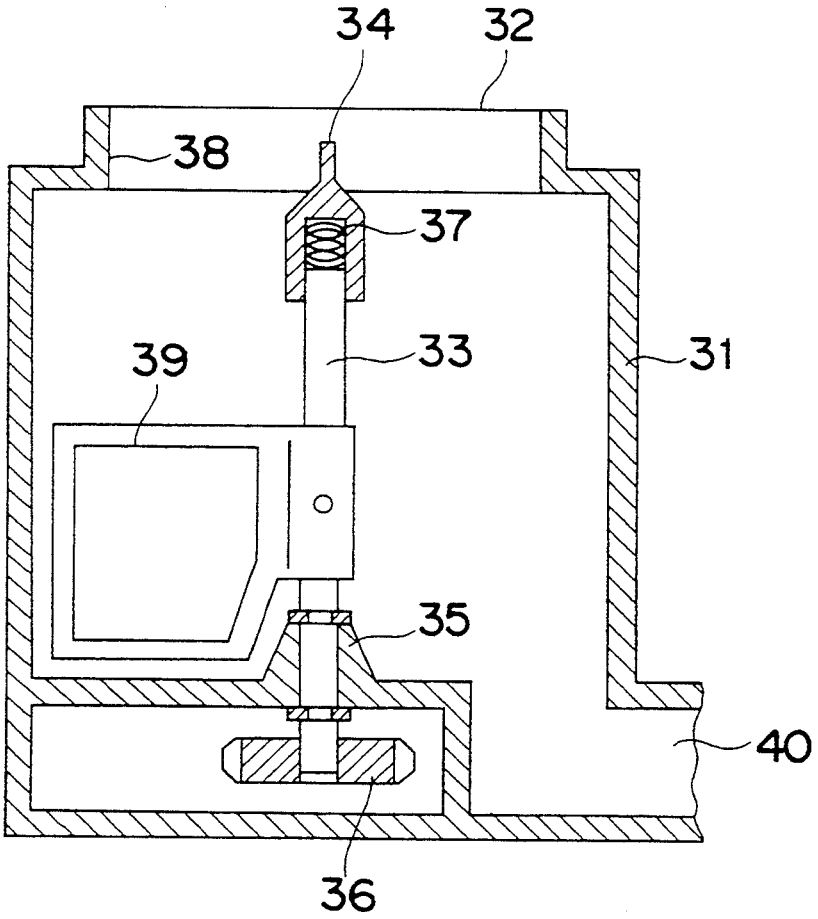
FIG. 3 is a side sectional view of a toner replenishing portion of a developing apparatus as related to a toner container according to a third embodiment of the present invention.
Figure 4A:
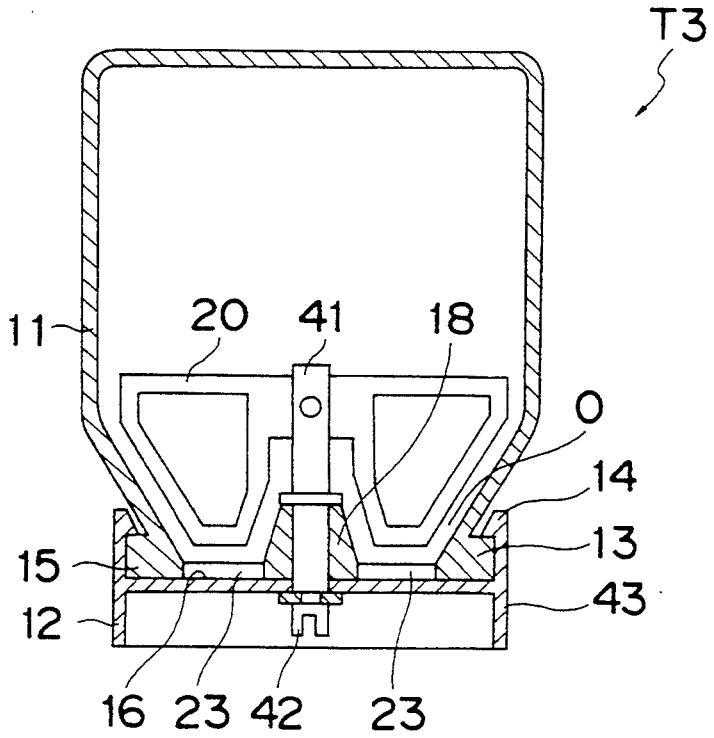
FIG. 4(A) is a side sectional view of a toner container according to the third embodiment of the present invention.
Figure 4B:
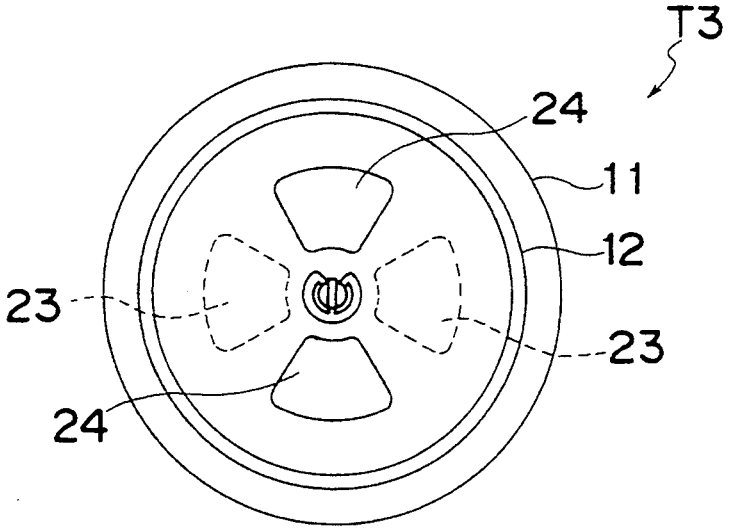
FIG. 4(B) is a bottom plan view of the toner container of FIG. 4 (A)

Referring next to FIG. 3, there is shown a toner hopper of a developing apparatus which is related to a toner container T3 shown in FIGS. 4(A) and 4(B) according to a third embodiment of the present invention.

In FIG. 3, the toner hopper generally includes a hopper main body 31 which accommodates developing toner therein so as to supply the toner to the developing apparatus (not shown here) through an outlet 40, with a toner replenishing port 32 having an inner peripheral face 38 being formed at an upper portion of the main body 31 for fitting with the cap member 12 of a toner container 11, a driving shaft 33 rotatably supported by a bearing portion 35 formed at a lower portion of the hopper main body 31, a driving gear 36 fixed to the lower end of the driving shaft 33 so as to be driven by a driving means (not shown), and a connecting member 34 formed with a connecting projection at its upper portion and mounted on the upper end of the shaft 33. The connecting member 34 is mounted to the shaft 33 by a known arrangement such as a spline, pin or the like through a compression spring 37 so as to be normally urged upwardly, and so as to be slidable in an axial direction, but fixed in a rotating direction with respect to the shaft 33. A hopper stirring blade 39 is fixed to the driving shaft 33.

FIGS. 4(A) and 4(B) show a toner container T3 according to the third embodiment of the present invention. The main difference between the toner container T3 of the third embodiment and that of the second embodiment is that the rotary shaft 17 in the second embodiment has been replaced by a rotary shaft 41 extending only half way within the container main body 11. The rotary shaft 41 is rotatably supported by the bearing portion 18 at its lower end which extends through the container main body 11 and the cap member 12, with the knob 21 dispensed with, and a groove 42 is formed at the lower end of the shaft 41 for engagement with the projection of the connecting member 34 of the toner hopper 31 as described with reference to FIG. 3.

Since the remaining construction of the toner container T3 in the third embodiment is generally similar to that of the toner container T2 of the second embodiment, detailed description thereof is abbreviated here for brevity of explanation, with like parts being designated by like reference numerals.

Still referring to FIGS. 3, 4(A) and 4(B), functioning of the toner container T3 and the developing apparatus according to the third embodiment of the present invention will be described hereinbelow.

In the first place, the cap member 12 of the toner container 11 is fitted into the toner replenishing port 32 of the toner hopper 31, and in this case, the inner peripheral face 38 of the toner replenishing port 32 is closely fitted with an outer peripheral face of the cap member 12 so as to prevent the toner from leaking through the fitted portion. During the above fitting, the projection of the connecting portion 34 is engaged with the corresponding groove 42 of the rotary shaft 41 of the container main body 11. Subsequently, the container main body 11 is rotated, with the cap member 12 fixed, so as to bring the opening portion 23 of the toner container into the open state. When the driving shaft 33 of the toner hopper 31 is driven by a driving means (not shown) in the above state, the driving force is transmitted from the connecting portion 34 to the rotary shaft 41 for rotation of the shaft 41. Subsequent functioning is generally similar to that of the second embodiment, and after completion of the toner replenishment, the container main body 11 is detached from the toner replenishing port 32 of the toner hopper after closing the opening portion 23 of the toner container. Since the connecting portion 34 of the hopper main body 31 is urged upwardly by the compression spring 37, in the case where the projection of the connecting portion 34 is not properly engaged with the groove 42 of the rotary shaft 41 during fitting of the toner replenishing port 32 with the cap member 12, the connecting portion 34 retreat downwards, and through rotation of the driving shaft 33, the projection of the connecting portion 34 and the groove 42 are engaged with each other. Thus, positioning or the like is not required during fitting between the toner replenishing port 32 and the cap member 12. Moreover, an inclined portion is provided at a stepped portion at the foot of the projection of the connecting portion 34, so that the toner falling from above during toner replenishment is not easily accumulated thereon. Moreover, the hopper stirring blade 39 is rotated simultaneously with the driving shaft 33, and thus, during the toner replenishment, prevents accumulation of the falling toner at a single position, while during normal use, the blade 39 also serves as a means for agitating the toner accommodated within the hopper main body 31.

The toner agitated by the hopper stirring blade 39 is fed to the developing apparatus (not shown) through the outlet 40 of the toner hopper main body 31 (FIG. 3).

As described above, according to the third embodiment of the present invention, by the arrangement in which the vertical driving shaft is provided in the toner hopper of the developing apparatus for coupling with the rotary shaft of the toner container, an improved toner container and developing apparatus which can automatize the toner replenishing work after fitting of the toner container may be realized.

Moreover, since the driving shaft 33 is also adapted to drive the hopper stirring vane 39 for stirring the toner within the hopper main body 31, the construction may be simplified without the necessity of separately providing an exclusive driving shaft.

Furthermore, owing to the arrangement that the rotary shaft 41 is disposed at the rotational center of the toner container 11 or cap member 12, there is no possibility that the positional relation of the rotary shaft with respect to the driving shaft 33 will be deviated even when the toner container 11 is rotated for opening or closing of the opening portion 23. Thus, the open/close operation of the opening portion 23 and the engagement between the rotary shaft 41 and the driving shaft 33 can be readily effected simultaneously.

Figure 5:
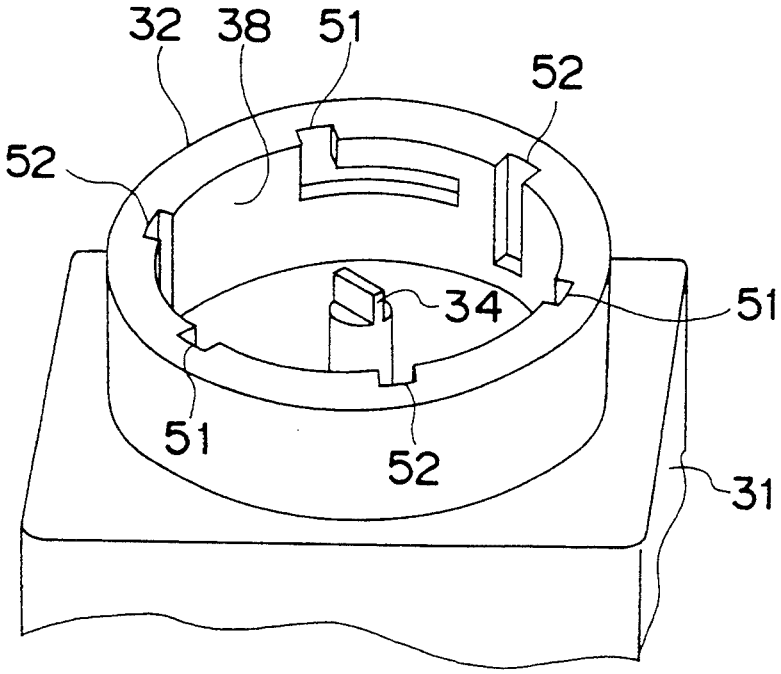
FIG. 5 is a fragmentary perspective view of a toner replenishing port of a developing apparatus according to a fourth embodiment of the present invention.
Figure 6:
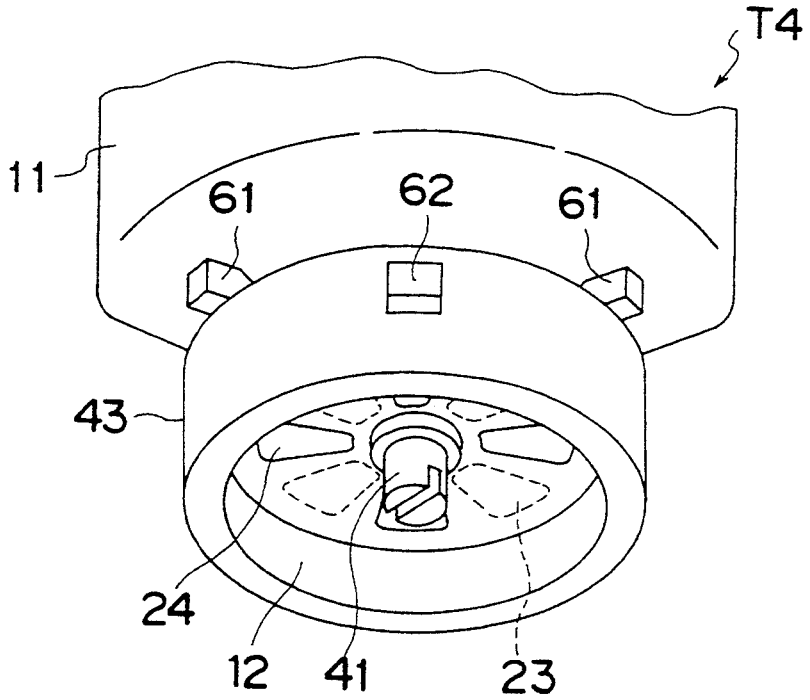
FIG. 6 is a fragmentary perspective view showing a lower portion of a toner container also according to the fourth embodiment of the present invention.

Referring to FIGS. 5 and 6, a toner container T4 and a developing apparatus related thereto according to a fourth embodiment of the present invention will be described hereinbelow.

It is to be noted here that FIG. 5 is a fragmentary perspective view of a toner replenishing port for the toner hopper of the developing apparatus (not shown here), and FIG. 6 is a fragmentary perspective view at the lower portion of the related toner container T4, according to the fourth embodiment of the present invention.

The difference between the toner hopper of FIG. 5 and the toner hopper as described with reference to FIG. 3 for the third embodiment is such that in the inner peripheral face 38 of the toner replenishing port 32, three cap member fixing grooves 52 and three main body fixing grooves 51 are respectively provided in spaced relation, as shown. Similarly, the difference between the hopper container of FIG. 6 and that as described with reference to the third embodiment of FIGS. 4(A) and 4(B) is that three main body claws 61 are provided on the container main body 11 in positions just above the cap member 12 for engagement with the three main body fixing grooves 51, while on the outer peripheral face of the cap member 12, three cap member claws 62 are provided for engagement with the cap member fixing grooves 52. It is to be noted here that in the embodiment of FIG. 6, four openings are respectively provided for the opening portions 23 and 24 at intervals of 90° C., with the rotational centers of the container main body 11, cap member 12, driving shaft 33 and rotary shaft 41 being adapted to coincide with each other.

Still referring to FIGS. 5 and 6, functioning of the toner container T4 and the developing apparatus related thereto according to the fourth embodiment of the present invention will be described hereinbelow.

When the cap member 12 for the toner T4 is gradually fitted into the toner replenishing port 32, the three cap member claws 62 are first engaged with the corresponding three cap member fixing grooves 52, with subsequent engagement of the three main body claws 61 with the three main body fixing grooves 51. Then, the container main body 11 is rotated clockwise, but because the cap member claws 62 are engaged with the cap member fixing grooves 52, the cap member 12 is prevented from rotation and only the container main body 11 is rotated. Moreover, the container main body 11 becomes undetachable from the toner replenishing port 32 due to the engagement of the main body claws 61 with the main body fixing grooves 51, and rotation thereof is prevented beyond the position where the opening portion 23 is brought into the closed state through a 45° rotation. Subsequently, the toner replenishing function is effected generally in the same manner as in the third embodiment. After completion of the toner replenishment, when the container main body 11 is rotated counterclockwise, the opening portion 23 is brought into the closed state, and the container main body 11 becomes detachable from the toner replenishing port 32.

As described so far, according to the fourth embodiment of the present invention, the cap member fixing grooves 52 and the main body fixing grooves 51 are formed in the inner peripheral face of the toner replenishing port 32, while the corresponding claws 62 and 61 are respectively provided on the cap member 12 and the container main body 11. The toner container and the developing apparatus can replenish toner in a simple manner by merely rotating the toner container, and also, positively prevent scattering of toner due to improper operation, etc.

It is to be noted here that in the fourth embodiment, although the main body claws 62 and the main body fixing grooves 51, and the cap member claws 62 and the cap member fixing grooves 52 are respectively provided in three places, the main body claws 61 and the main body fixing grooves 51 may each be reduced to at least one engaging portion, and the configurations thereof need not necessarily be limited to the claw and groove, but may be replaced, for example, by a protrusion in the form of a screw formed on each portion. Similarly, the cap member claws 61 and the cap member fixing grooves 52 may also each be reduced in number to at least one engaging portion, and the configuration thereof may be of any shape which will prevent rotation, for example, polygonal shapes on the outer and inner peripheral faces respectively.

Moreover, the main body fixing groove 51 and the cap member fixing groove 52 may be integrally formed.

Since the remaining construction and function of the toner container T4 and the developing apparatus of the fourth embodiment are generally similar to those of the toner container T3 and the developing apparatus of the third embodiment, detailed description thereof is abbreviated here for brevity of explanation, with like parts are designated by like reference numerals.

Figure 7:
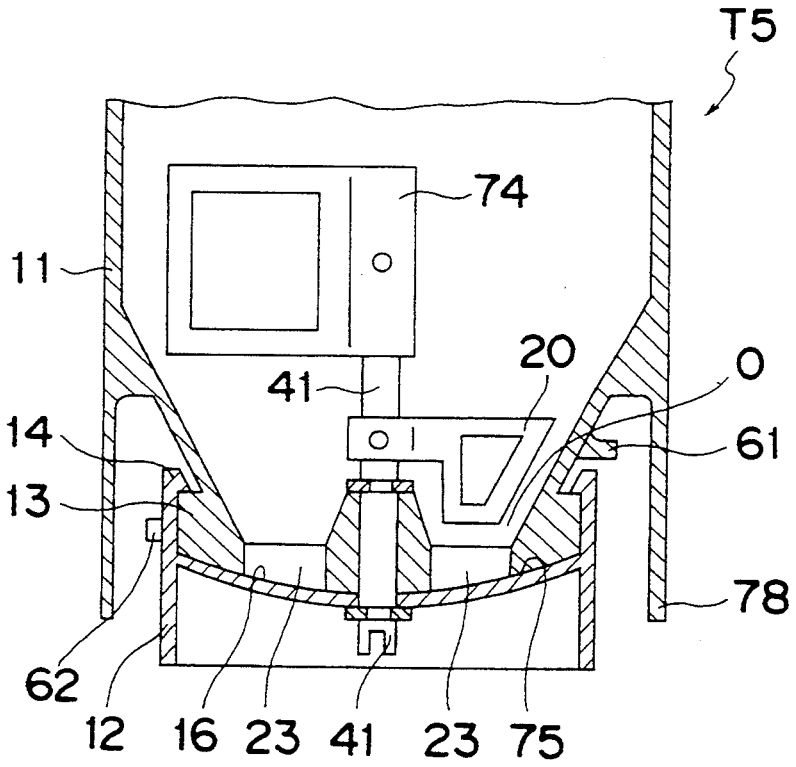
FIG. 7 is a fragmentary side sectional view of a toner container according to a fifth embodiment of the present invention.

FIG. 7 shows a toner container T5 according to a fifth embodiment of the present invention. The main differences between the fifth embodiment and the fourth embodiment of FIG. 6 (or the third embodiment of FIGS. 4(A) and 4(B)) are as follows. The outer peripheral side face of the container main body 11 is formed into a cover portion 78 which prevents spilling of toner from the container by erroneous opening of the opening portion 23 due to careless rotation of the cap member 12 by an operator, since it becomes impossible for the operator to grasp the cap member 12 due to the provision of such cover portion 78. The lower face 75 of the container main body 11 is curved outwardly (downwardly) and the sliding face 16 of the cap member 12 having a radius of curvature smaller than that of the lower face 75 (this may be a flat surface) is deformed to follow the face 75 so as to slide thereover. Also, a second stirring vane 74 is fixed at an upper end of the rotary shaft 41 in a position above the vane 20, as shown.

In the above arrangement of the fifth embodiment, toner is replenished in a similar manner to the third or fourth embodiment.

In the toner container T5 of the fifth embodiment of FIG. 7, since the lower face 75 of the toner container 11 has a curved face which is convex towards the outer side and the sliding face 16 of the cap member 12 is pressed against the lower face 75, the lower face 75 and the sliding face 16 can uniformly contact each other over their entire surfaces, thereby improving the sealing characteristics of the toner therebetween.

Moreover, the second stirring blade 74 is arranged to agitate the toner in the vicinity of the central portion of the container main body 11 during the toner replenishment for higher fluidity of the toner.

It is to be noted here that in the above fifth embodiment, although two stirring vanes are provided, such stirring vanes may be reduced to one in the same manner as in the first and fourth embodiments so long as sufficient fluidity is given to the toner. Also, the stirring member is not limited in its configuration, to the flat plate-like shape as described, but may be modified to a rod-like shape or coil-like shape so long as it is rotated with the rotary shaft 41 for efficiently agitating the toner within the toner container.

Since the remaining construction and function of the toner container T5 of the fifth embodiment are generally similar to those of the toner container T3 and T4 in FIGS. 4(A) and 4(B) and FIG. 6, detailed description thereof is abbreviated here for brevity of explanation, with like parts being designated by like reference numerals.

Figure 8:
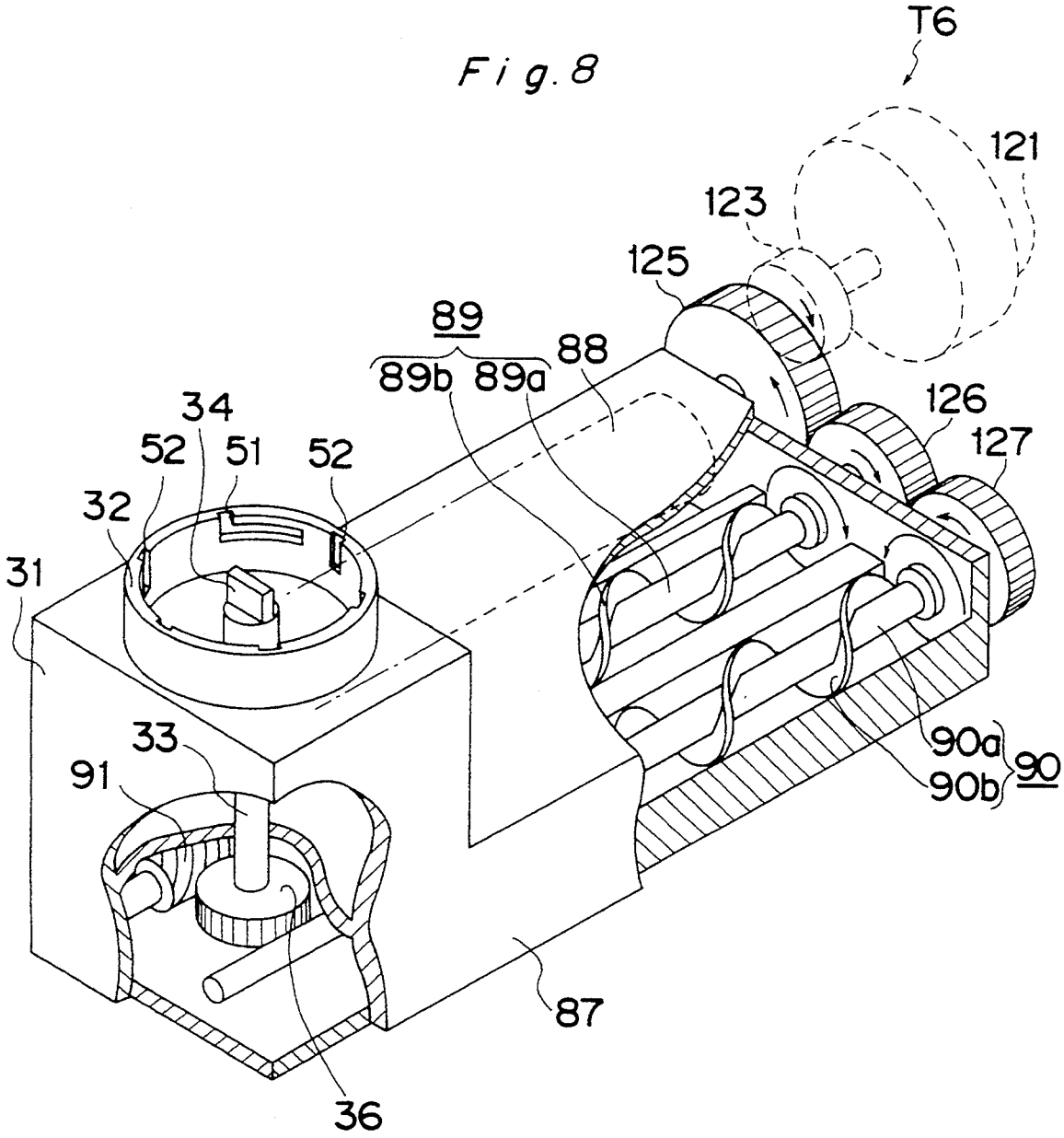
FIG. 8 is a schematic perspective view, partly broken away, showing a general construction of a developing apparatus according to a sixth embodiment of the present invention.

Referring further to FIG. 8, there is shown a developing apparatus T6 according to a sixth embodiment of the present invention, which generally includes a developing apparatus main body 87 of a rectangular cubic box-like configuration, a toner hopper 31 provided at one side of the apparatus main body 87 and having a toner replenishing port 32 at its upper portion, and a driving shaft 33 having a connecting portion 34 at its upper end and a driving gear 36 at its lower end. So far, the construction of the toner hopper 31 is generally similar to that described earlier with reference to FIGS. 3 and 5 and like parts are designated by like reference numerals. The developing apparatus T6 further includes a developing roller 88 rotatably supported horizontally within the developing apparatus main body 87 and directly connected with a gear 125 at its one end, a supply screw 89 having a shaft 89*a* and a screw 89*b* directly connected with a gear 126 at its one end and being rotatably supported within the main body 87 in parallel relation with the developing roller 88, and a collecting screw 90 having a screw 90*b* and shaft 90*a* directly connected with a gear 127 at its one end, the collecting screw 90 being rotatably supported within the main body 87 in parallel relation with the developing roller 88. The gears 125, 126 and 127 are engaged with one another as shown, while a gear 123 fixed to shaft of a motor 121 and constituting a driving means is in mesh with the gear 125 for the developing roller 88. Thus, upon rotation of the gear 123 in a direction indicated by an arrow, the gears 125, 126 and 127 for the developing roller 88, the supply screw 89 and the collecting screw 90 are respectively rotated in directions indicated by arrows. A worm gear 91 fixed to the other end of the shaft 89*a* for the supply screw 89 is in mesh with the driving gear 36 fixed to the lower end of the driving shaft 33. Thus, the toner within the toner hopper 31 can be circulated through respective passages by the supply screw 89 and the collecting screw 90, and also, can be supplied by a necessary amount to the developing roller 88 at all times.

With respect to the developing apparatus having the construction as described above, the functioning thereof will be described with reference to FIG. 8 only with respect to the points which are different from those of the embodiments of FIGS. 3 and 5.

During the toner replenishment, the driving means including the motor 121 and gear 123 rotates the supply screw 89 and the collecting screw 90, and the driving force thereof rotates the driving shift 33 through the driving gear 36 in the toner hopper 31. The driving means is preferably arranged to ultimately drive the driving shaft 33 at 60 r.p.m., whereby the stirring vane 20 of the toner container 11 slowly agitates the toner within the container main body 11 (not shown in FIG. 8), so as to decrease scattered toner falling from the container main body 11 and thereby reduce soiling at the toner replenishing port 32 and the toner container 11. The toner supplied into the hopper main body 31 is fed to the developing apparatus main body 87 during toner replenishment by the supply screw 89 and the collecting screw 90 for spreading throughout the entire developing apparatus.

As described so far, according to the present invention, by the arrangement to rotate the driving shaft, supply screw and collecting screw during the toner replenishment, the toner can be spread throughout the entire developing apparatus simultaneously with the replenishing function, and therefore, the developing apparatus may be caused to function immediately after the replenishment of toner, while any toner above the toner hopper capacity can be fed to the developing apparatus. Moreover, since the driving shaft and the supply screw can be driven by one driving source, the construction of the driving system is simplified.

Furthermore, by setting the number of revolutions of the driving shaft 33 at 60 r.p.m, it becomes possible to prevent scattering of toner during the toner replenishment, and also, to replenish the toner in an efficient manner.

Additionally, by connecting the driving shaft 33 with the supply screw 89 via the worm gear 91, the ratio of the number of revolutions between the driving shaft 33 and the supply screw 89 can be increased, and thus, it is possible to rotate the driving shaft 33 slowly so as not to scatter the toner, and to allow the supply screw 89 to supply a sufficient amount of toner to the developing roller.

In the sixth embodiment as described above, the number of revolutions of the driving shaft 33 is set at 60 r.p.m., but in order to prevent scattering of toner during replenishment and to supply toner in an efficient manner, the number of revolutions should preferably be above 20 r.p.m. and below 60 r.p.m.

It should also be noted here that the configuration of the supply screw 89 and the collecting screw 90 is not limited to the screw shape as illustrated in the above embodiment, but may be modified, for example, to a coil shape or belt shape. The developing roller 88, supply screw 89, collecting screw 90 and driving shaft 33 should preferably be coupled to each other so as to be driven by one driving source as in the above embodiment. The collecting screw 90 may be dispensed with if toner can be uniformly supplied to the developing roller 88 by only the supply screw 89. The terms "vertical direction" and "horizontal direction" represent the attitude of the developing apparatus during toner replenishment, and do not limit the attitude thereof during the developing function.

It should further be noted here that, in the case where toner is not scattered even when the number of revolutions of the driving shaft 33 is above 60 r.p.m. depending on the shapes of the toner container and toner hopper or characteristics of the toner, the number of revolutions may be above 60 r.p.m., and a means other than the worm gear 91 may be employed for connecting the driving shaft 33 to the supply screw 89.

Figure 9:
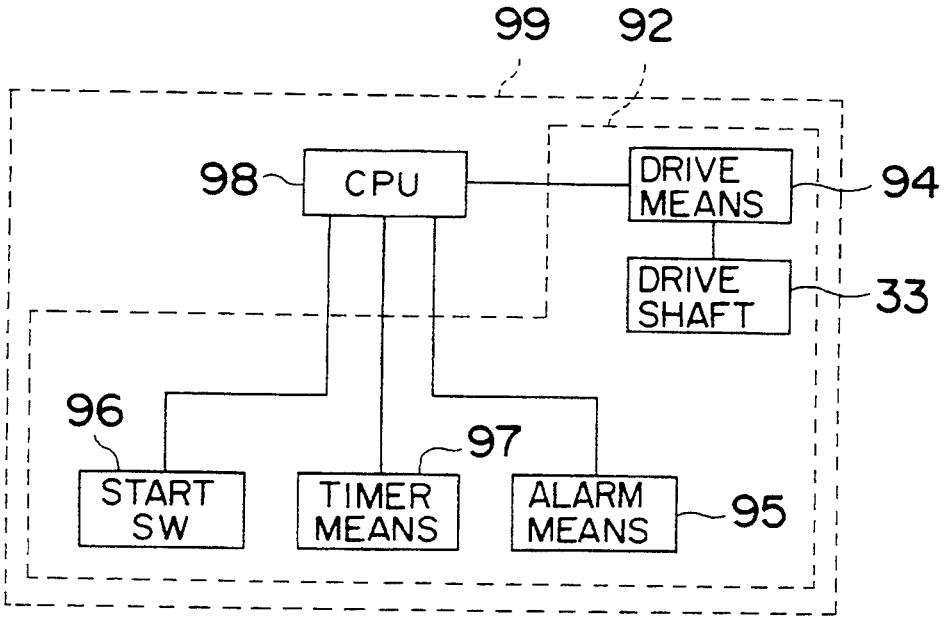
FIG. 9 is a block diagram for explaining an alarm function of a developing apparatus according to a seventh embodiment of the present invention.
Figure 10:
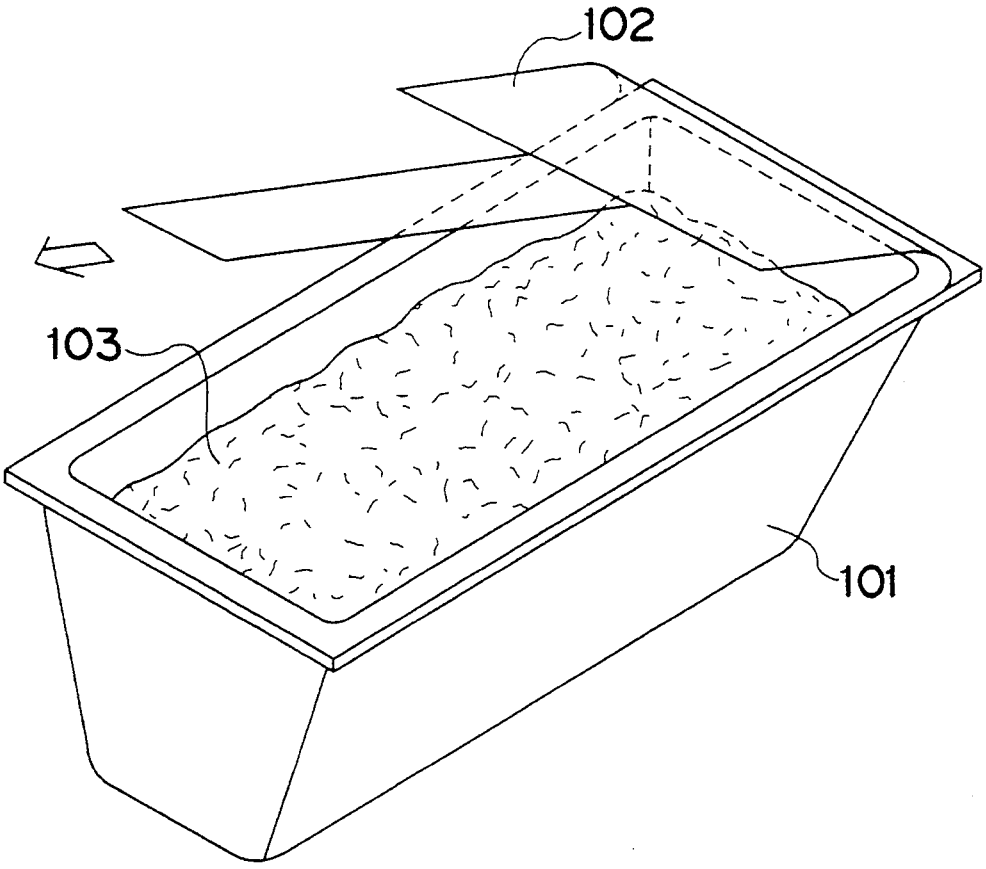
Fig.10 PRIOR ART
FIG. 10 is a perspective view showing a conventional toner container.
Figure 11:
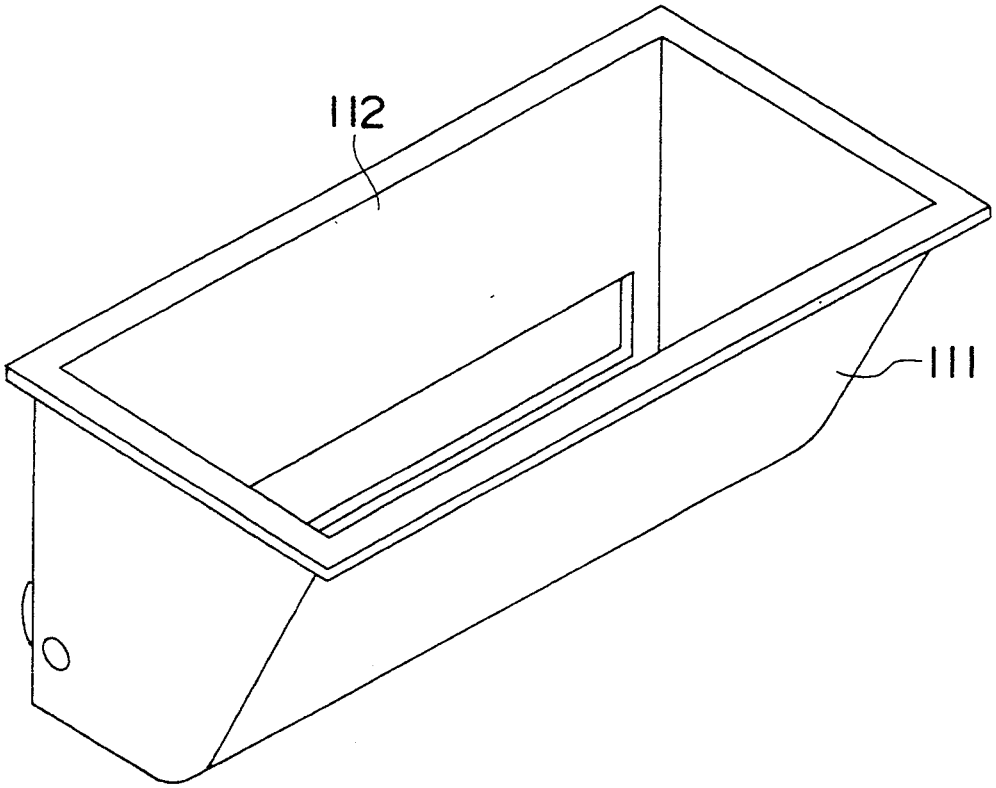
Fig. 11 PRIOR ART
FIG. 11 is a perspective view showing a conventional developing apparatus to be used with the toner container of FIG. 10.

Referring further to FIG. 9, a circuit arrangement for an alarm function of the developing apparatus according to a seventh embodiment of the present invention will be explained hereinafter. It is to be noted here that the construction of the developing apparatus main body is similar to that as described earlier with reference to the third embodiment of FIG. 3.

In the circuit arrangement of FIG. 9, a driving means 94 coupled to a CPU (Central Processing Unit) 98 drives the driving shaft 33. Included in the developing apparatus 92 are the above driving means 94, an alarm means 95, a start switch 96, a timer means 97 and the driving shaft 33 which are coupled to the CPU 98 to be controlled thereby. The CPU also controls an electrophotographic apparatus 99 which employs the developing apparatus 92.

Still referring to FIG. 9, functioning of the circuit arrangement for the developing apparatus will be described hereinbelow.

Upon depression of the start switch 96 by an operator, the CPU 98 turns ON the driving means 94, and simultaneously takes in the signal from the timer means 97 for counting the time. When the time has reached a predetermined time, the CPU 98 turns OFF the driving means 94, and also, turns ON the alarm means 95 so as to notify the operator of completion of the toner replenishment.

As described above, in the above embodiment, the time measuring means for measuring the driving time of the driving shaft is provided so as to signal the completion of the toner replenishment to the operator when the driving shaft has been driven for the predetermined timer period, whereby the toner replenishing work can be effected efficiently and without waste of time. It is also possible to prevent an accident such as scattering of toner in the surrounding portion due to detachment of the toner container before completion of the toner replenishment.

In the above seventh embodiment, the timer means 97 may be replaced by a means for counting the number of revolutions of the driving shaft 33.

It is desirable to employ a system in which the timer means 97 simultaneously serves as a timer for the CPU 98, and to move the counter by the clock signal thereof, to thereby measure the driving time by the value of the counter.

For the alarm means 95, means which may be seen, such as illumination of light emitting diodes, or heard, such as production of sound by a loud speaker is preferable. In the above embodiment, although it is so arranged that the CPU 98 turns OFF the driving means 94 when the driving shaft 33 has been driven for the predetermined period of time, the arrangement may, for example, be modified so that the operator turns OFF a switch when signalled by the alarm means 95, or so that the alarm means 95 is arranged so that the operator is notified by the stopping of the driving shaft 33 when the driving means 94 is turned OFF.

Moreover, the alarm means 95 and the start switch 96 may be arranged so as to simultaneously serve as an alarm and a switch associated with other elements of the electrophotographic apparatus 99. The driving means 94 should preferably be arranged to be integral with a driving means for driving other elements of the electrophotographic apparatus 99, and to be driven by one motor.

In the electrophotographic apparatus generally used, the initializing operation is normally effected such that various parts are subjected to idle running without forming images on a photoreceptor for the purpose of cleaning and stabilization of surface potential of the photoreceptor before starting image output operation. If the apparatus is so arranged to effect such initializing operation during the toner replenishment, and to rotate the rotary shaft of the toner container in association with the initializing operation, the operation may be simplified for more effective results.

In the second to seventh embodiments, although two or four openings are provided for the opening portions 23 or 24, the number of the openings is not limited to the above, but may be decreased or increased depending on necessity. Similarly, the configuration of the openings may also be modified, for example, to a circular shape, polygonal shape or slit-like shape.

Moreover, in the third to seventh embodiments, although the connection of the driving shaft 33 with the rotary shaft 41 of the toner container 11 is described as an engagement of the projection of the connecting portion 34 in the groove 42, the connecting means is not limited to the above, but may be modified to a connection of saw-tooth shaped portions or by magnets and the like. It is preferable that the opening portions 23 and 24 are remote from the rotational center as much as possible in order to prevent soiling of the connecting portions by toner, and that the end portion of the rotary shaft 41 has a shape which covers the connecting portion 34 upon connection.

Additionally, if the connection between the connecting portion 34 and the rotary shaft 41 is arranged so as to not require positioning therebetween, the urging by the compression spring 37 may be dispensed with. Similarly, the construction for the escape of the connecting portion 34 need not necessarily require the compression spring.

As described above, according to one aspect of the present invention, the toner container is provided with an open/close means for selectively opening or closing an opening portion of a toner discharge port of the container main body, and a stirring means having a rotary shaft extending through the toner container for stirring the toner contained within the toner container from outside thereof. Therefore, the toner replenishment can be effected in an efficient manner without soiling the related apparatus, hands of operators, etc.

Moreover, since the openings of the opening portion can be made small in size, the possibility of soiling may be reduced still further.

Furthermore, according to the present invention, by holding the cap member in sliding contact with the opening portion of the toner discharge port of the toner container main body for selective opening and closing of the opening portion, the opening and closing of the toner container may be positively effected by a still simpler operation.

In another embodiment of the present invention, the developing apparatus is provided with a toner replenishing port which is fitted with the toner container while the toner discharge port of the toner container is directed downwards, and with a vertically directed driving shaft to be connected with the rotary shaft of the toner container, such that discharge of toner from the toner container may be effected automatically.

Furthermore, according to the present invention, the toner container main body is provided with the flange-shaped portion and the cap member has a shape capable of engaging the toner replenishing port. In the developing apparatus, when the flange-shaped portion and the cap member are engaged with the toner replenishing port so as to fit the toner container into the toner replenishing port, and the toner container is rotated, rotation of the cap member is prevented, while the toner container is rotated to open the toner discharge port, and the toner container is positively attached to the developing apparatus. Upon rotation of the toner container in the opposite direction, the toner discharge port is closed and the toner container is brought into a state in which it can be detached from the developing apparatus. Thus, scattering of toner due to operator error can be advantageously prevented.

According to the present invention, the rotational centers of the toner container, cap member and rotary shaft are aligned, and the rotary shaft is adapted to extend through the container and the cap member. Thus, the toner replenishing function is simplified, and attaching and detecting of the toner container may be effected without any adverse effect to the connection between the rotary shaft and the driving shaft.

Moreover, in the present invention, the portion of the toner discharge port held in sliding contact with the cap member is arranged to have outwardly convex shape, whereby the sealing characteristic for the toner at the sliding portion is further improved.

The developing apparatus of the present invention is provided with the developing roller rotatably supported in the horizontal direction, and the toner transport means disposed in parallel relation with respect to said developing roller for supplying the toner in the toner hopper onto the developing roller, and the toner transport means and the driving shaft are associated with each other. Thus, the initializing function of the developing apparatus after replenishment of the toner can be dispensed with, while any toner amount above the hopper capacity may be supplied, with simultaneous simplification of the driving system.

Moreover, according to the present invention the connection between the driving shaft and the toner transport means is effected through the worm gear, so that the number of revolutions of the driving shaft becomes less than 60 r.p.m., whereby soiling in the vicinity of the openings of the toner container and the toner replenishing port of the developing apparatus can be advantageously suppressed, and thus, the toner may be replenished in an efficient manner.

Still further, the developing apparatus of the present invention is provided with the means for measuring the time during which the rotary shaft is driven during the toner replenishment, and the alarm means for signaling the completion of the toner replenishment is arranged to function when the rotary shaft has been driven by a predetermined period of time, and thus, erroneous detachment of the toner container by the operator before the replenishing function is completed can be prevented.

Although the present invention has been fully described by way of example with reference to the accompanying drawings, it is to be noted here that various changes and modification will be apparent to those skilled in the art. Therefore, unless such changes and modifications otherwise depart from the scope of the present invention, they should be construed as included therein.

What is claimed is:

1. A developing apparatus comprising:

a toner container including a container main body having a first end with a toner discharge opening formed therethrough, and a cap member rotatably mounted to said first end of said container main body, said cap member having a wall portion which is in sliding contact with said first end of said container main body, and said wall portion having an opening formed therethrough which is selectively alignable with said toner discharge opening of said first end of said container main body to selectively open and close said toner discharge opening;

a toner hopper including a replenishing port with a cylindrical wall formed thereabout and adapted to releasably engage said toner container;

a first rotary shaft rotatably mounted to said toner container, said first rotary shaft extending through said wall portion of said cap member and through said first end of said container main body of said toner container;

a stirring member mounted to said first rotary shaft and disposed within said container main body;

a second rotary shaft rotatably mounted to and disposed in said toner hopper and being coaxial with said cylindrical wall formed about said replenishing port;

a drive member fixed to said second rotary shaft and adapted to be operably coupled to a rotary drive source;

an agitator mounted to said second rotary shaft and disposed in said toner hopper;

engaging means for engaging said container main body in said cylindrical wall such that said container main body is rotatable relative to said cylindrical wall and so that said container main body is prevented from being pulled out of said cylindrical wall;

cap member coupling means for coupling said cap member to said cylindrical wall such that said cap member is fixed against rotation relative to said cylindrical wall;

shaft coupling means for coupling said first rotary shaft to said second rotary shaft, such that said first rotary shaft is rotated together with rotation of said second rotary shaft, upon said container main body being engaged in said cylindrical wall by said engaging means; and wherein said cap member coupling means, said engaging means and said wall portion of said cap member together constitute an automatic means for automatically opening said toner discharge opening and causing toner in said container main body to fall from said container main body into said toner hopper when said toner container is disposed so that said toner discharge opening is directed downwardly and when said container main body is moved from a disengaged position to an engaged position in which it is engaged in said cylindrical wall by said engaging means such that said container main body is prevented from being pulled out of said cylindrical wall, and for automatically maintaining said toner discharge opening closed to prevent the toner in said container main body from falling out of said container main body through said toner discharge opening when said container main body is not in said engaged position in said cylindrical wall.

2. A developing apparatus as recited in claim 1, further comprising a developing apparatus main body operably coupled to and communicated with said toner hopper in such a manner that when said replenishing port of said toner hopper is facing upwardly, said developing apparatus is disposed substantially horizontally;

a developing roller rotatably mounted in said developing apparatus so as to extend substantially horizontally when said developing apparatus is disposed substantially horizontally;

a toner transport means mounted in said developing apparatus and extending in parallel with said developing roller for supplying toner from said toner hopper toward said developing roller; and wherein said second rotary shaft, said developing roller and said toner transport means are operably coupled with one another such that said developing roller and said toner transport means are driven when said second rotary shaft is rotated.

3. A developing apparatus as recited in claim 1, wherein said engaging means comprises a main body claw fixed to and protruding from one of said cylindrical wall and said cap member, and a main body fixing groove formed in the other of said cylindrical wall and said cap member and being adapted to receive said main body claw.

4. A developing apparatus as recited in claim 3, wherein said main body fixing groove is formed in said cylindrical wall and includes a first portion extending in an axial direction of said cylindrical wall and a second portion, contiguous with said first portion, extending in a circumferential direction of said cylindrical wall.

5. A developing apparatus as recited in claim 3, wherein said cap member coupling means comprises a cap member claw fixed to and protruding from one of said cap member and said cylindrical wall, and a cap member fixing groove formed in the other of said cap member and said cylindrical wall and adapted to receive said cap member claw.

6. A developing apparatus as recited in claim 1, wherein said cap member coupling means comprises a cap member claw fixed to and protruding from one of said cap member and said cylindrical wall, and a cap member fixing groove formed in the other of said cap member and said cylindrical wall and adapted to receive said cap member claw.

7. A developing apparatus as recited in claim 1, wherein said shaft coupling means comprises a connecting member mounted on an end of said second rotary shaft and having a flat portion, a compression spring interposed between said end of said second rotary shaft and said connecting member, and a slot formed in an end of said first rotary shaft and adapted to receive said flat portion of said connecting member.

8. A developing apparatus as recited in claim 1, wherein said automatic means is operable to allow said container main body to be rotated relative to said cylindrical wall from a disengaged position to said engaged position while preventing said cap member from rotating relative to said cylindrical wall, and to, in the engaged position, allow said container main body to rotate relative to said cylindrical wall and prevent said cap member from rotating relative to said cylindrical wall so that said toner discharge opening is automatically opened when said container main body is rotated from the disengaged position to the engaged position.

9. A developing apparatus as recited in claim 1, wherein said shaft coupling means is operable to automatically couple said first and second shafts for rotation with one another when said toner container and said toner hopper are in said engaged position and said second shaft is rotated.

10. A developing apparatus as recited in claim 1, wherein said cap member is mounted outside said container main body and over said first end of said container main body.

* * * * *